US006325213B1

(12) United States Patent
Landis, II

(10) Patent No.: US 6,325,213 B1
(45) Date of Patent: Dec. 4, 2001

(54) PLASTIC CONTAINER FOR FOOD PRODUCTS

(75) Inventor: Henry J. Landis, II, Orland Park, IL (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 08/975,149

(22) Filed: Nov. 20, 1997

(51) Int. Cl.[7] ..... B65D 21/00

(52) U.S. Cl. ..... 206/519; 206/508; 220/359.1; 220/380; 220/612; 220/613; 220/608

(58) Field of Search ..... 206/519, 508, 206/520; 220/359.1, 359.4, 380, 612, 613, DIG. 31, 608, 609; 428/542.8

(56) References Cited

U.S. PATENT DOCUMENTS

| | | | |
|---|---|---|---|
| Re. 31,912 | | 6/1985 | Fortuna et al. . |
| D. 252,796 | | 9/1979 | Fortuna et al. . |
| D. 254,293 | | 2/1980 | Fortuna et al. . |
| D. 270,813 | | 10/1983 | Fortuna . |
| D. 271,665 | | 12/1983 | Fortuna et al. . |
| D. 272,320 | | 1/1984 | Fortuna . |
| D. 274,217 | | 6/1984 | Aramaki . |
| D. 281,303 | | 11/1985 | Fortuna . |
| D. 281,399 | | 11/1985 | Fortuna . |
| D. 283,595 | | 4/1986 | Fortuna et al. . |
| D. 283,596 | | 4/1986 | Fortuna et al. . |
| D. 283,677 | | 5/1986 | Fortuna et al. . |
| D. 283,678 | | 5/1986 | Fortuna et al. . |
| D. 283,791 | | 5/1986 | Fortuna et al. . |
| D. 283,793 | | 5/1986 | Fortuna et al. . |
| D. 284,350 | | 6/1986 | Fortuna et al. . |
| D. 284,940 | | 8/1986 | Fortuna et al. . |
| D. 285,530 | | 9/1986 | MacLaughlin . |
| D. 285,531 | | 9/1986 | Peterson et al. . |
| D. 285,532 | | 9/1986 | MacLaughlin . |
| D. 285,536 | | 9/1986 | MacLaughlin . |
| D. 285,653 | | 9/1986 | Fortuna et al. . |
| D. 285,654 | | 9/1986 | MacLaughlin . |
| D. 285,655 | | 9/1986 | MacLaughlin et al. . |
| D. 285,774 | | 9/1986 | MacLaughlin . |
| D. 285,775 | | 9/1986 | MacLaughlin . |
| D. 291,060 | | 7/1987 | MacLaughlin . |
| D. 291,062 | | 7/1987 | MacLaughlin . |
| D. 369,971 | * | 5/1996 | Brauner et al. ..... D9/428 |

(List continued on next page.)

FOREIGN PATENT DOCUMENTS

| | | | |
|---|---|---|---|
| 0 159 051 | | 10/1985 | (EP) . |
| 1252434 | * | 11/1971 | (GB) ..... 206/519 |
| 2 156 265 | | 10/1985 | (GB) . |
| 2 156 268 | | 10/1985 | (GB) . |
| 2 163 124 | | 2/1986 | (GB) . |
| 2 252 093 | | 7/1992 | (GB) . |
| 532248 | * | 2/1993 | (JP) ..... 220/608 |

*Primary Examiner*—Stephen P. Garbe
*Assistant Examiner*—Joseph C. Merek
(74) *Attorney, Agent, or Firm*—John A. O'Toole; Douglas J. Taylor; Everett G. Diedericks

(57) ABSTRACT

A two part plastic container for food products is provided having a main body and a base for being attached to the bottom of the body. The body has a frustoconical sidewall with a radial bottom rim and the base has a shorter frustoconical sidewall with a radial bottom rim. The rims are advantageous in that they allow stacks of the container bodies and bases to be processed with container feeding equipment presently in use as the rims provide distinct structure for being fed by the mechanical devices of the equipment. An energy director area is provided between the rims for ultrasonically attaching the container body and base. The container body has a smooth sidewall over substantially its entire extent without indentations or bumps for maximizing the printing area thereon. Both the container body and base minimize the size of their respective nest intervals when stacked to conserve space for shipping and processing purposes while still allowing for easy denesting with parts readily separated from the stack due to the provision of the rims.

20 Claims, 4 Drawing Sheets

U.S. PATENT DOCUMENTS

| | | | | |
|---|---|---|---|---|
| 3,039,646 | | 6/1962 | Merz . | |
| 3,478,913 | | 11/1969 | Kemp . | |
| 3,499,567 | * | 3/1970 | Spotrs | 215/42 |
| 3,666,088 | * | 5/1972 | Wingardh | 206/508 |
| 4,049,122 | * | 9/1977 | Maxwell | 206/520 X |
| 4,193,494 | * | 3/1980 | Green | 206/519 X |
| 4,326,567 | | 4/1982 | Mistarz . | |
| 4,386,999 | | 6/1983 | Fortuna et al. . | |
| 4,496,066 | | 1/1985 | Bullock, III . | |
| 4,514,242 | | 4/1985 | MacLaughlin et al. . | |
| 4,515,651 | | 5/1985 | MacLaughlin et al. . | |
| 4,556,445 | | 12/1985 | McCormick . | |
| 4,560,064 | | 12/1985 | Peterson et al. . | |
| 4,572,851 | | 2/1986 | Fortuna . | |
| 4,575,987 | | 3/1986 | Fortuna . | |
| 4,583,656 | * | 4/1986 | MacLaughlin | 220/359.5 |
| 4,584,037 | | 4/1986 | Fortuna et al. . | |
| 4,610,351 | * | 9/1986 | Coles et al. | 206/519 X |
| 4,613,746 | | 9/1986 | MacLaughlin . | |
| 4,618,516 | * | 10/1986 | Sager | 428/542.8 |
| 4,636,349 | | 1/1987 | MacLaughlin . | |
| 4,826,039 | | 5/1989 | Landis . | |
| 4,872,586 | | 10/1989 | Landis . | |
| 5,024,340 | * | 6/1991 | Alberghini et al. | 220/608 |
| 5,176,284 | * | 1/1993 | Sorensen | 206/519 X |
| 5,180,599 | * | 1/1993 | Feldmeier et al. | 220/359.1 X |
| 5,263,606 | * | 11/1993 | Dutt et al. | 220/613 |
| 5,377,861 | | 1/1995 | Landis . | |
| 5,484,072 | * | 1/1996 | Beck et al. | 220/609 |
| 5,992,629 | * | 11/1999 | Gullord et al. | 206/459.1 |

* cited by examiner

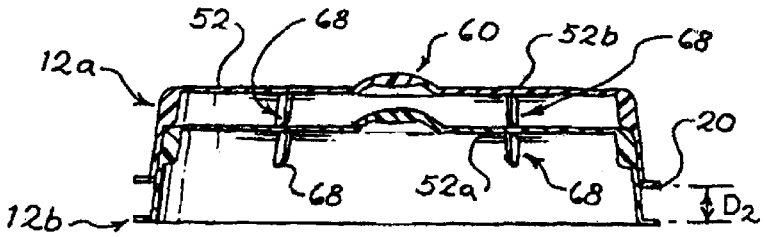
Fig. 12
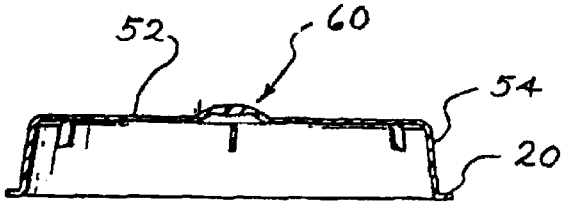
Fig. 7
Fig. 5
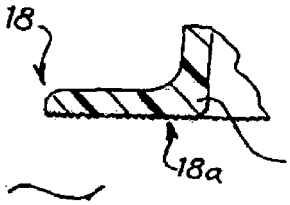
Fig. 3
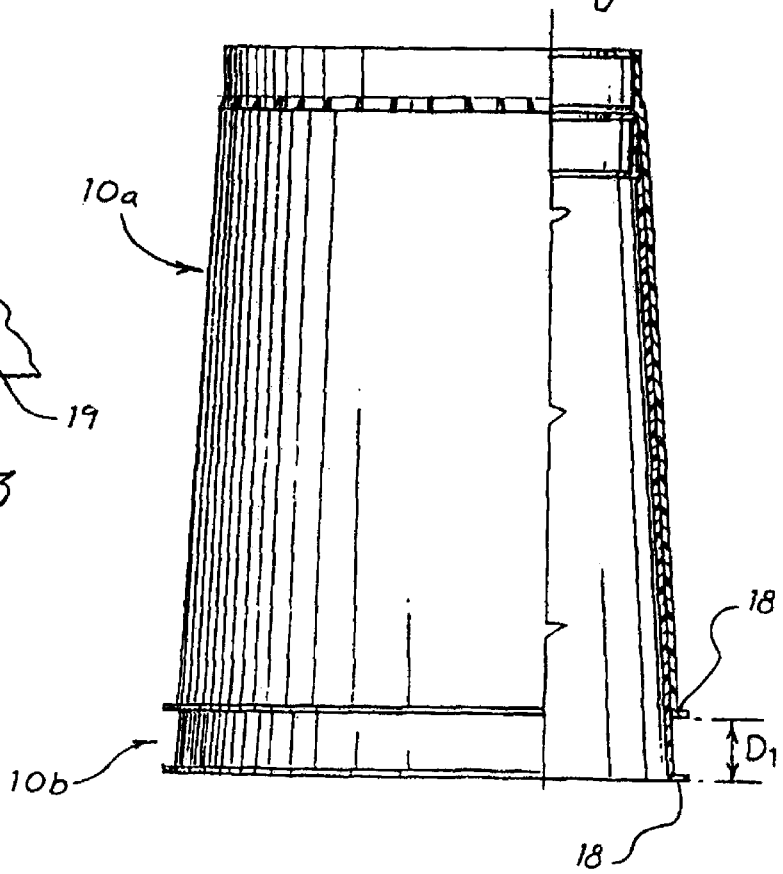

Fig. 8
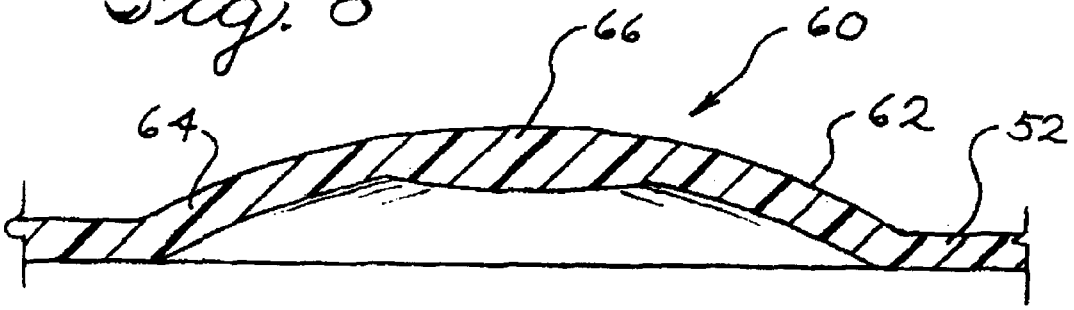
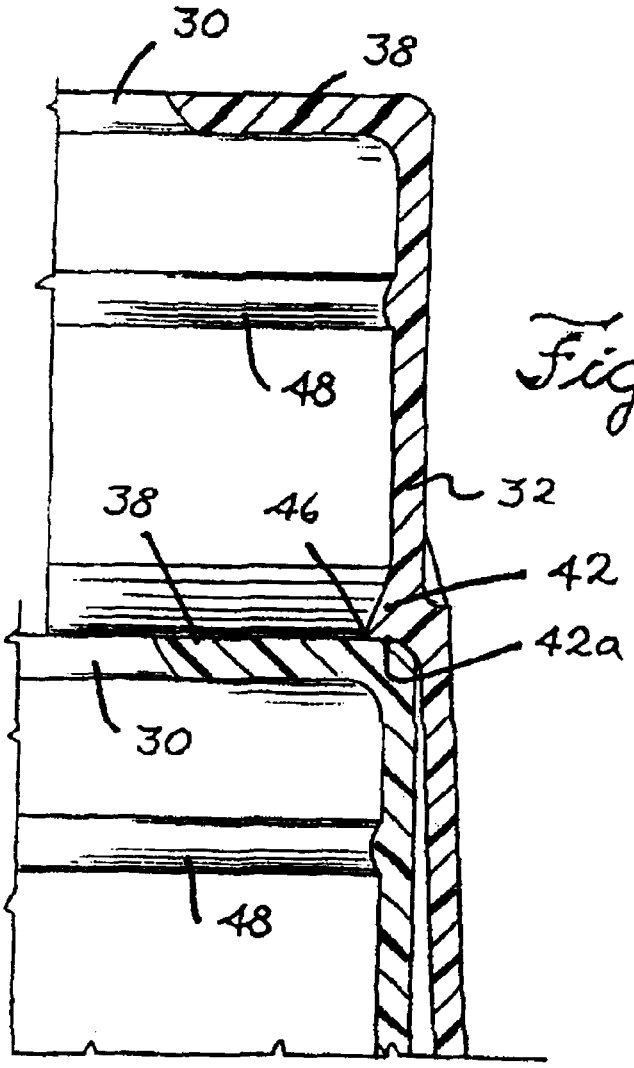
Fig. 13

PLASTIC CONTAINER FOR FOOD PRODUCTS

FIELD OF THE INVENTION

The invention relates to plastic containers, and ore particularly, to injection-molded containers for containing food products.

BACKGROUND OF THE INVENTION

One area where the use of plastic containers has become widespread is in the food packaging industry. Accordingly, it is common for these plastic food containers to serve as the end display package in which the product is presented for sale to the customer. Typical of these containers are those used for dairy products such as cottage cheese, sour cream, or the like where an integral body of the container is provided having a sidewall that tapers down to an integral transverse bottom wall with the top opening being closed by a plug fit lid. Normally, the lid has a depending peripheral skirt which locks onto the upper rim of the tapered wall of the container body. One difficulty encountered in the design of closure lids for the containers described above is ensuring that when they are nested in a stack such as for shipping, the stacked lids maintain a constant gap between adjacent skirts of respective stacked lids. Maintaining uniform gap spacing is important to allow them to be efficiently utilized with high-speed automated packaging equipment which position the containers for automatic filling and automatically caps the filled containers with lids taken from the stack by mechanical devices of the equipment. Various rib structures have been employed with lids to provide the requisite spacing, see e.g. U.S. Pat. Nos. 4,826,039 and 5,377,861, both commonly assigned to the assignee herein.

Many of these food product plastic containers have their parts formed by a thermoforming process. In thermoforming, a thin plastic sheet is formed into the desired shape by heating and forcing the sheet against a mold to produce a container part having a uniform, very thin, cross-sectional thickness which can result in a part having very flexible walls. In the particular application of interest herein, currently there is a flavored yogurt thermoformed container that has a reverse tapered sidewall with a larger diameter bottom and being open at both the smaller diameter top and at the bottom thereof. A separate bottom closure member is also formed by thermoforming and is spinwelded to the sidewalls to close off the bottom for receiving yogurt therein. The bottom closure includes a base panel and depending skirt wall which is spinwelded to the interior surface of the body wall to permanently attach the pieces together. Thus, unlike the previously described top closure lids which are designed to be opened, the bottom closures for yogurt containers do not have a locking skirt which locks onto a rim of the sidewall and which can be opened to gain access to the food therein. Instead, after being filled with yogurt, the top is closed by a flexible foil seal as by an adhesive. To gain access to the yogurt, the seal is peeled open from over the opening at the top of the container sidewall.

The thermoformed and spinwelded yogurt containers described above suffer from numerous shortcomings. For spinwelding the bottom closure to the container body wall, both pieces are provided with integral gripping lugs which project relatively far radially inward relative to the body and skirt walls so that they can be grasped by the spinwelding equipment for rotating the two parts relative to each other to create frictional heating for welding the parts together. The bottom closure has the lugs formed on its skirt, and the body sidewall has lugs around the top thereof. The spinwelding technique requires specialized handling and filling equipment that results in a relatively slow production of containers for filling.

Since the parts of the above-described yogurt container are thermoformed parts having a constant wall thickness, the radially inward projecting lugs form corresponding indentations on their exterior wall surfaces. Because of the aforementioned display function of the exterior surface of the yogurt container, maximizing the amount of surface area available for printing information, such as product characteristics, e.g. ingredients, nutritional content, or other required information about the product, is an important consideration, especially where the containers are relatively small, such as for example with the preferred 6 oz. yogurt containers herein. The lugs at the top of the wall restrict the height of the printing that can be received on the container sidewall. In addition, there are unsightly indentations on the sidewall due to the lugs that are readily visible to the purchaser, and because of the radial extent to which they project into the container interior, they can unduly interfere with removing the food product therefrom, e.g. spooning yogurt out from the container. Accordingly, there is a need for a plastic container for food products such as a yogurt container which is more aesthetically pleasing, and better maximizes the print receiving surface area thereon.

Another significant characteristic the containers should possess is the ability to stack with uniform spacing between the container parts and so that while stacked, adjacent parts do not become jammed and wedged together. In addition, the space taken up by a given number of stacked container parts should be minimized. The above described lugs of the prior yogurt container, in addition to their grasping function for spinwelding provide a stacking surface with their bottom flat surfaces. The indentations of the lugs extend relatively far down the sidewalls spaced from the top in both the container body and the bottom closure. This precludes stacking of these container parts in a compact fashion.

It is also important that the container be adapted to be used with conventional automated container feeding equipment that is currently employed in container filling assembly and printing operations. Both the upper container wall and the bottom closure lack an annular rim for feeding with mechanical mechanisms or devices such as mechanical fingers, feed screws or shuttles of the automated feeding equipment commonly used with the packaging of diary products.

As previously mentioned, thermoformed plastic containers generally have very thin cross-sectional thickness so that their walls can be very flexible. This is especially true with the bottom closure of the above described yogurt container where the skirt sidewall is relatively thin in thickness and the base panel is quite wide in diameter which can cause the closure member to be very pliable.

SUMMARY OF THE INVENTION

In accordance with the present invention, an improved, injection-molded plastic container is formed with an upper main body portion ultrasonically welded to a lower body portion. Preferably, each of the body portions has a small annular rim that is abutted and welded together to form the container. The annular rims allow use of conventional, automatic, container feeding apparatus having mechanical devices for insertion between nested rims in a stack of container portions. As will be explained in greater detail, the ultrasonic welding is a faster process than the spinwelding process currently in use. Thus, an improved, automated process of forming the container and filling the same can be obtained with this new injection-molded container.

The upper body portion and lower base portion of the container herein are ultrasonically connected together with there being an energy director area between the upper and lower container portions for facilitating the ultrasonic welding process. In the preferred form, the energy director area is provided between the rims of the container body and base. As the container herein avoids spinwelding the parts together such as in the previously described yogurt container, there is no need to provide lugs for grasping the container parts for relative rotation thus eliminating the large indentations that can be seen on the outer surface of the corresponding body portion of the prior yogurt container. Accordingly, the present container has an exterior surface portion of the frustoconical wall of the container body that is smooth over substantially its entire extent extending substantially between the top and bottom of the frustoconical wall so as to provide a large uninterrupted smooth area on the body wall to receive printing thereon. Thus, the container herein maximizes its surface area for receiving print in contrast to the prior spinwelded container having indentations formed by the gripping lugs over which printing cannot be applied.

The base wall of the lower container portion may be provided with a substantially centrally located raised portion that is disposed in the container interior when the upper and lower container portions are ultrasonically attached. The raised portion has inclined surfaces relative to the base wall for distributing loads about the center of the base panel to provide added container strength for meeting the drop test requirements for the container.

Because each of the container portions is injection molded, it may have thick cross-sectional areas where needed to add strength to the overall container to meet drop tests. The thermoformed containers cannot add thickened cross-sectional areas because the container is formed from a sheet of uniform cross-sectional thickness.

Stacking shoulders disposed adjacent the tops of the upper and lower container portions are preferably provided so as to minimize the distance between the tops of the container portions and their respective stacking shoulders for providing stacking of upper container portions on each other and lower container portions on each other in a compact, vertical arrangement. Accordingly, an increased number of container portions can be stacked in a given space versus the prior spinwelded container which have stacking surfaces on the bottom of the spinwelding lugs that are further down from the top of the corresponding container portion sidewalls. In contrast to the prior container, the present stacking shoulders are closely adjacent the tops of the container portions to minimize the nest interval between stacked parts for more compact stacking. The present container body and base can have a smaller nest interval over that of corresponding parts of the prior container without causing a problem in separating parts from the stack with the container feeding equipment due to the provision of the rims that are lacking in the prior spinwelded container and which can be readily engaged by the equipment's mechanical devices for separation. In addition, with respect to the open-ended container body, there is less of a concern with developing a vacuum type seal between closely stacked parts having tapered walls that would make it more difficult to properly separate the stacked container bodies in a stack with small nest intervals.

BRIEF DESCRIPTION OF THE DRAWINGS

FIG. 3 is an enlarged sectional view of the rim of the container main body showing the rough surface at the bottom thereof for ultrasonically welding with a corresponding rim of a lower base portion of the container;

FIG. 5 is an elevational view partially in section showing two container body portions stacked one on top of the other in a compact, vertical arrangement;

FIG. 7 is a cross-sectional view taken along line 7—7 of FIG. 6;

FIG. 8 is an enlarged sectional view of a raised dome provided on the container base portion;

FIG. 12 is a sectional view showing two container base portions stacked one on top of the other in a compact, vertical arrangement; and FIG. 13 is a fragmentary, cross-sectional view showing two container bodies stacked together.

DETAILED DESCRIPTION OF THE PREFERRED EMBODIMENT

Figure 6:
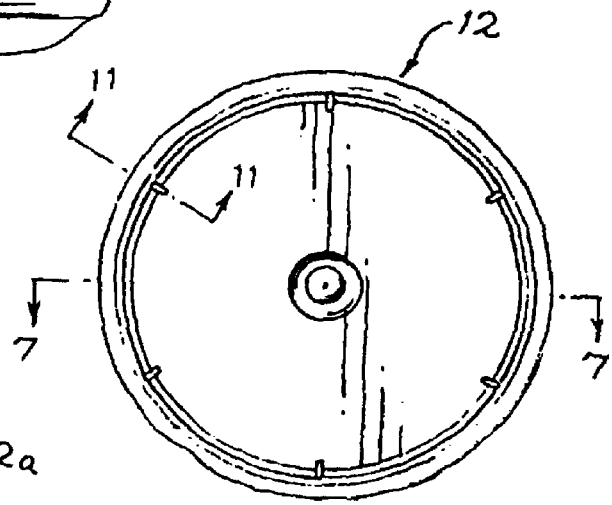
FIG. 6 is a bottom plan view of the container lower base portion having inner stacking ribs formed therearound.
Figure 11:
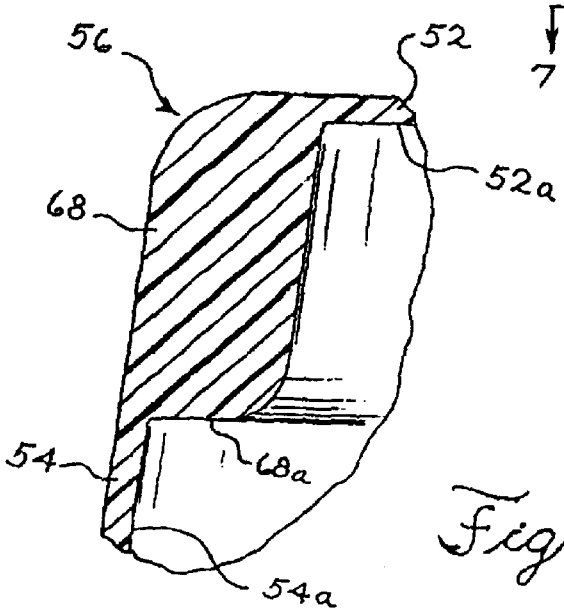
FIG. 11 is an enlarged sectional view taken along line 11—11 of FIG. 6.

The container described herein is a two-part container having an upper main body portion 10 (FIG. 1) and a lower base portion 12 (FIG. 6) which is to be attached at the bottom of the main body portion 10 so as to form an open top container for being filled with food products. The preferred application is as a container for yogurt and the exemplary dimensions set forth herein for the container portions 10 and 12 are for a container that is filled with 6 oz. of flavored yogurt; however, it will be understood that size of the container portions and the dimensions can be varied from that described herein and still fall within the scope of the present invention. After being filled, the open top is then sealed by a thin seal member 14 which can be adhered to the top of the main body portion 10 for sealing the food product in the interior 16 of the container.

One important advantage conferred by the upper and lower portions 10 and 12 of the present container is that they are stackable in a very compact and stable manner so as to conserve space during transport of large volumes of these container portions and to enable them to cooperate with presently available automated container feeding equipment that is currently being used with plastic food containers for processing thereof. Both the container body 10 and base 12 are provided with lower annular flanges or rims 18 and 20, respectfully, which project radially outward from the bottom of the respective container portions. As can be seen by reference to FIGS. 5 and 12, the respective rims 18 and provide distinct structure on the container body portions 10 and 12 for readily allowing mechanical devices (not shown) of the feeding equipment to fit between adjacent rims in the stack for separating the container body portions in the stack for further processing. In addition, the rims 18 and 20 can include an energy director area therebetween to facilitate ultrasonic bonding of the rims 18 and 20 together to attach the container base 12 to the container body 10, as will be more fully described hereinafter.

A significant advantage in using an ultrasonic bonding between the upper and lower container portions is that of speed of operation and the elimination of specialized spinning equipment to spin one piece relative to the other piece.

Another significant advantage of providing the ultrasonic bonded rims 18 and 20 over the spinwelding process used to attach the prior yogurt containers is that the exterior surface 22 of the container body 10 can be smooth over substantially its entire extent providing a large uninterrupted, smooth area for receiving printing thereon. This is in direct contrast to the prior spinwelded container which, as previously described, has spinwelding lugs formed around the top of the corresponding container body for being grasped by the spinwelding equipment. The lugs create large indentations in the container surface which limit the height of printing on the container exterior surface and thus do not maximize the surface area for printing as with the present ultrasonically welded container.

Figure 2:
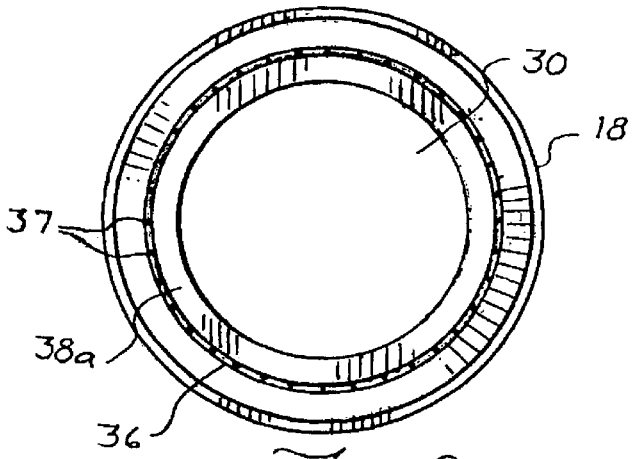
FIG. 2 is a plan view of the container body of FIG. 1.
Figure 10:
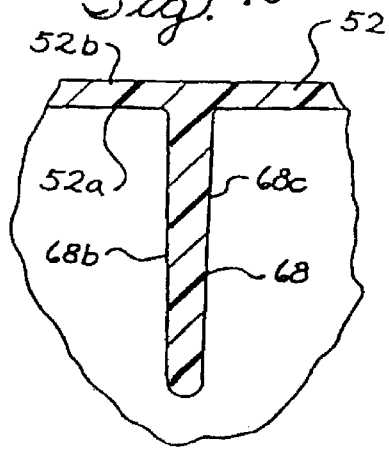
FIG. 10 is an enlarged sectional view of one of the stacking ribs of the container base portion.
Figure 1:
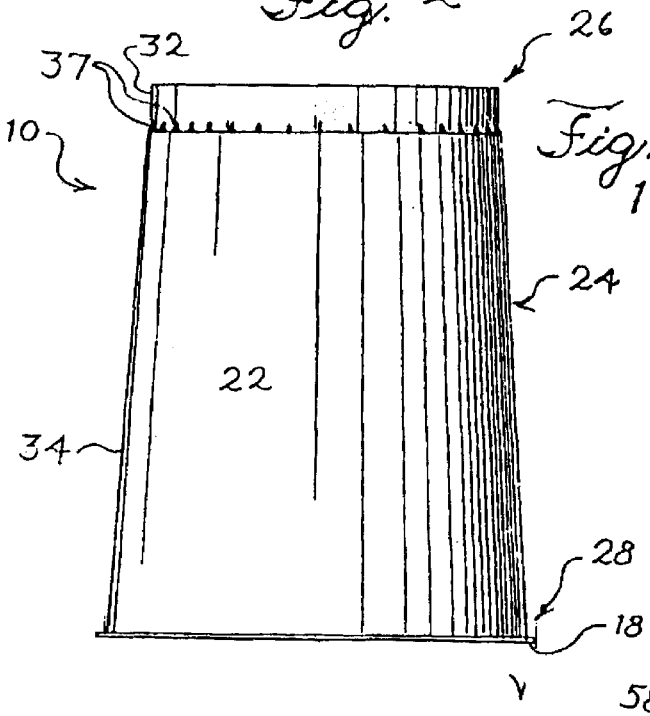
FIG. 1 is an elevational view of an upstanding main body portion of a plastic container for containing food products in accordance with the present invention showing a frustoconical wall of the container body having a larger diameter at its bottom and a radially outward projecting annular rim thereat.

The details of the illustrated and preferred embodiment of the container portions 10 and 12 will next be more specifically described. Referring to FIG. 1, the container body 10 has a sidewall 24 which has a generally frustoconical shape so that it tapers from a smaller diameter top 26 to a larger diameter bottom 28 at which the annular rim 18 is formed and projects radially outward therefrom. As previously mentioned, the bottom 28 is closed off by the container base 12 which is ultrasonically welded thereon leaving a mouth 30 at the sidewall top 26 open for being filled with the food product into the container interior 16.

Figure 4:
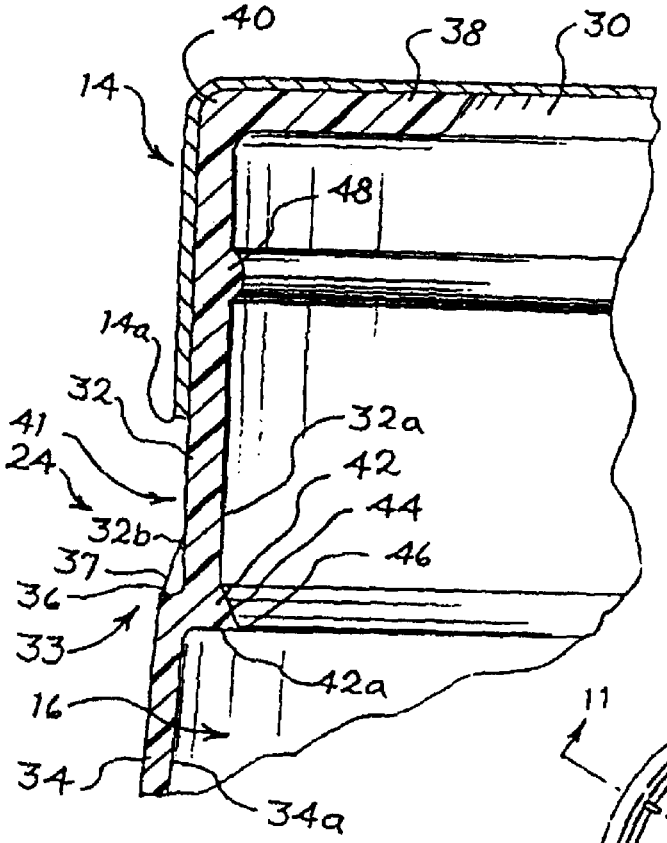
FIG. 4 is an enlarged sectional view of an inner stacking ring of the container main body and showing a portion of a seal member sealingly attached over the top opening of the container body.

As best seen in FIG. 4, the container body sidewall 24 includes a short upper thick wall section 32 and a lower thinner wall section 34 therebelow. By way of example and not limitation, the preferred thickness for the thick wall section 32 can be approximately 0.020 inch and the preferred thickness of the thinner wall section 34 can be approximately 0.016 inch. The thickness of the rim 18 at the bottom of the wall section 34 is approximately 0.018 inch. To achieve the different wall thicknesses for the sections 32 and 34 and rim 18, the container herein is preferably injection molded.

Injection molding the present container portions 10 and 12 is advantageous over the prior thermoformed yogurt container portions in that thermoforming generally involves the stretching of a uniform thickness sheet of plastic that causes thin areas at some locations and a loss of strength at a location where more strength may be desired. In an injection-molded container, increased wall thickness may be added where desired to provide the desired strength. Further, thermoforming does not allow the control of a radius or the forming of sharp corners that can be achieved with injection molding; and these can lead to the telescoping together of containers during shipping or in certain drop tests. For example, as best seen in FIG. 3, the flange 18, to be sonically welded, is made thicker in cross-section than the cross-section of container sidewall 24. Also, a corner 19 joining the sidewall 24 to the flange 18 is made substantially thicker than the container wall or the flange to add mass to the corner in order to make it stronger. Thus, more plastic can be added selectively to the weldable flange 18 and to the corner 19 without adding to the mass of the rest of the container, as would be necessary in a thermoformed container. The thermoformed walls for these containers are typically on the order of only about 0.010 or 0.011 inch thick. Also, because the injection-molded walls need not have a uniform thickness throughout, this allows different portions of the wall to be designed with various thicknesses and shapes such as the above-described container sidewall 24 having thick and thinner sections 32 and 34, thereof.

Returning to FIG. 4, it can be seen that the thick wall section 32 stands substantially vertical or at a very slight incline relative to the lower thinner wall section 34 which tapers at more of an angle, e.g. 3.5° from vertical, down to the larger diameter bottom 28 of the sidewall 24. The preferred distance from the top 26 of the thick wall section 32 of the sidewall 24 down to the bottom 28 of the flange rim 18 is approximately 3.486 inches. In addition, the thick wall section 32 steps down from the thinner wall section 34 at exterior shoulder 36 so as to have a smaller diameter relative to the progressively increasing top to bottom diameter of the wall section 34 with the distance from the shoulder 36 to the container body top 26 being short relative to the distance from the shoulder 36 down to the rim 18. The step of the shoulder 36 is approximately 0.015 inch so that the exterior surface **32*b* of wall section 32 is substantially axially aligned with interior surface 34*a* of wall section 34 at the top thereof. A radially inward projecting lip 38 is provided at the upper end of the wall section 32 and terminates radially distal from the wall section 32 around the container mouth opening 30**.

In injection molding of the container, upper body portion 10, forces occur during the stripping of the body portion from the mold as the core is pulled out that tend to form a crease in the sidewall 32 above the shoulder 36. To add strength to the sidewall 32, to resist such creasing, a series of ribs 37 are formed on the outside surface of the container extending upwardly, as viewed in FIG. 4, from the shoulder 36. The ribs 37 add more mass and strength. The preferred ribs have a 4:1 slope with the ribs being four times as high as wide in the radial direction.

For the preferred yogurt container by way of example and not limitation, the exterior diameter of the vertical thick wall section 32 is approximately 2.061 inches; and the exterior diameter of the tapered thin wall section 34 at its smallest diameter top portion adjacent transition region 33 is approximately 2.090 inches with the interior diameter being approximately 2.060 inches, and at its largest diameter at the rim 18, it has an exterior diameter of approximately 2.477 inches. The outer diameter of the radial rim 18 is approximately 2.64 inches. The annular lip 38 can extend radially from the top 26 of thick wall section 32 for approximately 0.154 inch so that the mouth 30 has a diameter of approximately 1.748 inch. The distance from the shoulder 36 to the top 26 of the thick wall section 32 is approximately 0.310 inch, and the distance down from the shoulder 36 to the top of the rim 18 is approximately 3.158 inches so that the total height of the container body 10 in the preferred 6 oz. yogurt container embodiment is approximately 3.486 inches, as previously mentioned. As is apparent, because of the location of the shoulder 36 at the transition region 33 high up along the sidewall 24 so that there is a relatively short upper thick wall section 32, there remains a much longer distance for the smooth wall section 34 so as to provide the food container herein with a large, uninterrupted surface area on its exterior sidewall surface 22 for receiving printing thereon. It has been found that in the preferred 6 oz. yogurt container, the wall section 34 provides for approximately 2.87 inches of printing height which is about 10% greater than that afforded with the prior thermoformed and spin-welded container. The median printable circumference around the wall section 34 is 7.17 inches, and less a 3/16 inch vertical gap, the printable circumference is 6.99 inches.

The foil seal member 14 is adhered over the container top 26 so as to seal the mouth 30 and extends on the upper surface 38*a* of the lip 38 around the substantially right angle corner 40 formed between the lip 38 and wall/section 32 and down towards the shoulder 36 on the exterior surface of the wall section 32 stopping at end 14*a* thereof. As the foil seal member 14 stops short of the exterior shoulder 36, a gripping space 40 is provided around the bottom of the wall section 32 between the seal member bottom end 14*a* and the exterior shoulder 36. Thus, to open the container by removal of the foil seal member 14, a person can insert their finger into the gripping space 40 for engaging the seal member end 14*a* with their fingers and peeling it from the exterior of the upper wall section 32 and lip 38 to remove the seal member 14 from across the container mouth for accessing the food product e.g. yogurt, in the container interior 16.

For stacking of container bodies 10, the container sidewall 24 has an interior stacking shoulder or ring 42 formed integrally thereon and projecting radially into the container interior 16 substantially radially aligned with the exterior shoulder 36 so that the stacking ring 42 is provided at the transition region 33 of the sidewall 24 relatively close to the top 26 of the container body 10 between the container wall sections 32 and 34. As best seen in FIGS. 4 and 13, the bottom surface 42*a* of the stacking ring 42 is spaced below the top surface of the shoulder 36 preferably by approximately 0.020 inch. The container bodies 10 are stacked with the top lip 38 of the lower container body 10*b* abutting the flat bottom surface 42*a* of the stacking ring 42 of the upper container body 10*a* as shown in FIG. 13. The distance of the nest interval $D_1$ (FIG. 5) between rims 18 of adjacent container bodies 10*a* and 10*b* will be substantially equal to the short distance between the top of the lip 38 and the ring bottom surface 42*a* which in the preferred form with the dimensions of the container body 10 as set forth earlier where the container is used as a yogurt container with the container interior filled with 6 oz. of yogurt, gives a nest interval $D_1$ of 0.330 inch that is substantially less then the interval provided with the prior spinwelded yogurt container utilizing the lugs as the stacking structure. With the small nest interval D, of the 0.330 inch, there will be a small air gap of approximately 0.004 inch between adjacent wall sections 34 of container bodies 10*a* and 10*b* in the stack. Thus, the present container bodies 10 can be stacked in a much more compact, vertical arrangement providing for substantial savings in transportation costs in that a much greater number of container bodies 10 can be stacked in a prescribed space. This allows, for instance, a greater number of stacked container bodies 10 to be put into a carton box for shipping.

As mentioned, the container body 10 and base 12 are preferably both integral injection-molded pieces. Injection molding allows these plastic parts to be formed with more intricate shapes and walls and allows more control over the shape and cross-sectional thicknesses of the plastic so as to enhance the performance and durability of these plastic parts such as when subject to drop testing. In this regard, the transition region 33 between the thick wall section 32 and the thin wall section 34 has a fairly intricate shape with sharp angled corners on the exterior flat shoulder 36 and the inner stacking ring 42. For example, as can be seen in FIG. 4, the stacking ring surface 42*a* intersects with an inclined surface 44 at sharply angled corner 46 radially distal from the slightly radiused right angle juncture of the surface 42*a* with the inner surface 34*a* of the wall section 34.

In the preferred 6 oz. yogurt container, the corner 46 is radially spaced from the inner wall surface 34*a* a short distance of 0.034 inch so as not to unduly interfere with scooping of food from the container interior 16 while still providing for secure and stable stacking, as more fully discussed herein. The angled inclined surface 44 extends upwardly and radially outward from the corner 46 to the interior surface 32*a* of the wall section 32. As this transitional region 33 is thicker from between the corners of the shoulder 36 and ring 42 relative to wall sections 32 and 34, it also adds strength to the container wall 24. The intricate shape of the wall including the transition area 33 between the wall sections and the sharp corners and flat surfaces thereof are readily produced by injection molding whereas thermoforming a container having these types of sharply angled surface features would be much more difficult, if not impossible.

Additionally, the container body 10 is molded with an inner circumferential bead 48 which is used to strip the container body from the mold. The bead 48 is raised from the wall section inner surface 32*a* and is integral therewith, and likewise the bead 50 is raised from the wall section inner surface 34*a* and is integral therewith. Preferably the bead 48 is spaced down from the bottom of the lip 38 to its radial inwardmost point by a distance of 0.100 inch with the radial spacing of this inwardmost point from the wall section interior surface 32*a* being approximately 0.005 inch.

The stacking ring 42 extends continuously around the inner circumference at the transition area 33 of the sidewall 24 so as to present an unbroken flat surface 42*a* to be engaged with the flat top surface of the top lip 38 for stacking in a secure and stable manner. The continuous stacking ring surface 42*a* is molded flat to be abutted with a corresponding flat surface on the top of the lip 38 of an adjacent stacked container. Such an arrangement in the stack presents less of a risk of slippage of the engaged surfaces off from each other, especially when considered in conjunction with the thicker, stronger reinforced wall 24 of the container body 10. This is particularly important when the container bodies 10 are loaded in the stack as wedging and jamming of the stacked container portions can prevent separation by the mechanical devices of automatic feeding equipment with which the container portions 10 and 12 are to be utilized. Thus, the stacking structure including the ring surface 42 and the lip 38 of the present container body 10 is effective to maintain a constant and small uniform gap or nest interval D, between stacked container bodies 10 while keeping them stacked in a secure and stable manner.

Figure 9:
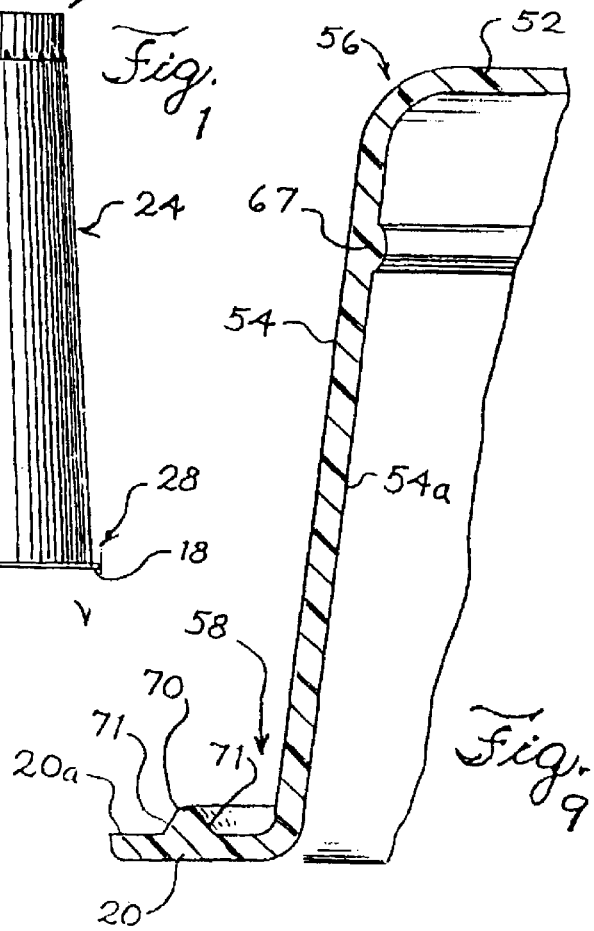
FIG. 9 is an enlarged sectional view of the frustoconical sidewall of the container base portion and showing an annular rim projecting radially outward from the bottom of the wall and including an energy director area of the rim for ultrasonically attaching the rims of the container body and base portions together.

Similar to the container body 10, the container base 12 is an injection-molded part so that it can be formed with a more intricate shape including having integral walls with different thicknesses. Referring to FIGS. 7 and 9, the container base includes an upper panel wall 52 and a frustoconical sidewall 54 which depends from the periphery of the panel wall 52 at the top 56 of the wall down to its bottom 58 at which annular rim 20 is formed. Similar to rim 18, the rim 20 projects radially outward from the wall bottom 58. The panel wall 52 is preferably slightly thicker in cross-sectional thickness than both the frustoconical sidewall 54 and the annular rim 20, with annular rim 20, in turn, being slightly thicker than the frustoconical sidewall 54.

For example, in the preferred form as a yogurt container, the container base 12 has a base panel 52 with a thickness of 0.018 inch, a frustoconical sidewall 54 with a thickness of 0.016 inch and an annular rim 20 with a thickness of 0.017 inch. The sidewall 54 tapers at about 7.5° from the vertical and has a vertical height from top 56 to the bottom of the rim 20 of approximately 0.500 inch. The diameter across the panel wall 52 is preferably approximately 2.334 inches with the diameter across the outer edges of the rim 20 being larger, preferably on the order of 2.640 inch. As discussed earlier, the base panel wall 52 has a relatively large diameter in comparison to the height of the sidewall 54 so that the panel 52 is more easily deflected when subject to loads due to the large span across the top 56 of the sidewall 54. By injection molding the panel wall 52 so that it is thicker than the sidewall 54, the panel wall 52 is provided with enhanced rigidity so as to be better able to withstand drop tests. To assist in withstanding drop tests and preventing any cracking of the walls 52 and 54 of the base member 12, a raised dome 60 is integrally formed at the center of the panel wall 52, as best seen in FIG. 8. The dome 60 has an arcuate inclined surface 62 relative to the flat panel wall 52 so that any loads on the center of the panel 52 will be substantially distributed thereabout so as to avoid stressing the panel center with direct loads thereon. The dome 60 adds strength and improved load bearing capacity such as when filled containers are subjected to drop tests. Instead of flexing the center of the panel wall 52, the loading created by the food product in the dropped containers will be distributed over the panel.

The dome 60 is preferably provided with a wall having different thicknesses with annular inclined portion 64 being thicker than the panel wall 52 and the top enlarged portion 66 being thicker than the annular portion 64. So, for example, with the preferred panel thickness of 0.018 inch, the annular wall portion 64 will have a thickness of approximately 0.022 inch and the enlarged top portion 66 will have a thickness of approximately 0.032 inch at its thickest point at the center of the base 12. By providing the central top portion 66 as the thickest portion of the dome 60, the dome 60 itself is stiffened against flexing at its highest central point over the base panel wall 52 so as to improve its load distributing characteristics. Also, similar to body side wall 24 having bead 48, base wall 54 includes an integral raised bead 67 (FIG. 9) formed on the wall surface 54*a* to aid in pulling the container base 12 from the mold. At its radially inwardmost point, the bead 67 is preferably spaced approximately 0.093 inch down from the bottom surface 52*a* of panel wall 52 and radially inward approximately 0.005 inch from wall surface 54*a*.

For stacking purposes, the container base wall 52 has integral circumferentially spaced stacking ribs 68 that are adjacent the top 56 of the sidewall 54 so as to minimize the nest interval $D_2$ when the container bases 12*a* and 12*b* are stacked, as shown in FIG. 12. The ribs 68 are integrally formed at the junction of the panel wall horizontal surface 52*a* and frustoconical wall inclined surface 54*a* and project down from the horizontal surface 52*a* of the panel wall 52 a short distance so that when the upper horizontal surface 52*b* of the panel wall 52 of the lower base 12*b* engages with the generally flat bottom surface 68*a* of the ribs 68 of the upper base 12*a*, the nest interval $D_2$ between the container bases 12 is minimized. More specifically, the nest interval $D_2$ between the stacked bases 12 will be approximately equal to the distance from the bottom surface 68*a* of the stacking ribs 68 to the horizontal upper surface 52*b* of the panel wall 52. With the preferred panel wall thickness of 0.018 inch between lower and upper wall surfaces 52*a* and 52*b*, the preferred distance between the stacking rib bottom surface 68*a* and the panel wall lower horizontal surface 52*a* is approximately 0.182 inch so as to provide a 0.200 inch nest interval $D_2$ between adjacent stacked container bases 12. The stacking interval $D_2$ is significantly less then the stacking interval of the corresponding container bases in the prior yogurt container so that the container bases 12 herein can be stacked in a more compact, vertical arrangement providing advantages similar to the container body 10 in terms of a number of container bases 12 that can be shipped in a given amount of space such as in a box carton. Because of the small nest interval $D_2$, the stacked bases 12*a* and 12*b* have a small air gap of approximately 0.0058 inch between adjacent base sidewalls 54.

An additional advantageous characteristic of the stacking ribs 68 over the prior lugs is that the ribs 68 project inwardly relative to the base walls 52 and 54 without the corresponding indentation formed in the walls exterior surfaces as with the thermoformed lugs. Accordingly, the ribs 68 provide a support and stiffening function as they gusset the walls 52 and 54 relative to each other so as to enhance the strength at the top juncture 56 between the base panel wall 52 and the frustoconical sidewall 54. In this manner, the stacking ribs 68 serve to stiffen the container base walls 52 and 54 so as to improve their performance when subjected to drop tests, as previously described. In the preferred yogurt container form, the ribs 68 project approximately 0.073 inch radially inward along the horizontal wall surface 52*a* from the frustoconical wall surface 54*a*, and as previously mentioned, project downwardly along the inclined wall surface 54*a* approximately 0.182 inch from the panel lower horizontal surface 52*a*. The ribs 68 can have sides 68*b* and 68*c* provided with a slight draft, such as 1° from the vertical, to converge towards the rib bottom surface 68*a* with a thickness between sides 68*b* and 68*c* being approximately 0.020 inch.

To ultrasonically attach the container base 12 to the body 10, the respective annular rims 18 and 20 are welded so that to form welded plastic areas between the rims for connecting the base 12 to the body 10. More specifically, the rim 18 of the container body 10 has a lower surface 18*a* that is provided with a roughened irregular texture to facilitate ultrasonic bonding to the container base flange 20. In this regard, the container base rim 20 is provided with an upstanding annular energy director 70 projecting from its upper surface 20*a*, preferably approximately 0.015 inch high, and having a rounded top triangular cross-sectional shape, as best seen in FIG. 9. Accordingly, when a single container body 10 and a container base 12 are removed from their respective stacks such as by the mechanical devices of the processing equipment in engagement with the rims 18 and 20 and brought together in the ultrasonic fixture, the annular rims 18 and 20, and more particularly the textured bottom surface 18*a* and the energy director 70 will be brought into high frequency vibration with one another with the energy concentrated at the rounded top of the energy director 70. The molded textured surface 18*a* increases the abutting surface area between it and the raised energy director 70 so as to increase the frictional heat generated between the vibrating surfaces improving the melt of the energy director areas and bond quality between the rims 18 and 20. The preferred energy director adds more mass of plastic to the flange 20 and has a 0.010 inch radius on its top with sloping walls 71 (FIG. 9) defining a 60° angle therebetween and a height of 0.015 inch. Once the container base 12 is ultrasonically welded to the container body 10, the automatic feeding equipment can take the welded container by the attached rims 18 and 20 to a filling station for being filled with food products and then on to a sealing station where the foil seal member 14 is adhered over the open mouth 30 of the filled container.

As previously mentioned, the container herein allows the mechanical devices of automated feeding equipment to be readily implemented with the radially projecting welded rims 18 and 20. Also, as previously discussed, the ultrasonic attachment of the container portions 10 and 12 eliminates the spinwelding process used to attach the prior yogurt container portions so that the present container, and of particular importance, the main body portion 10 thereof, no longer need include relatively large indented lugs that are provided towards the top of the container. In this manner, substantially the entire extent of the container body exterior surface 22 can be utilized to receive print thereon maximizing the surface area of the container body 10 used for this purpose. The container body 10 and base 12 herein are substantial improvements in terms of their strength for withstanding the drop tests to which they are subjected and for their processing in that they are readily adapted for use with currently employed automated container feeding equipment. Moreover, both the container body 10 and base 12 are provided with stacking structure so that their stack intervals between adjacent stacked pieces is reduced so that more parts can be stacked in a given space, and so that the stacking can occur in a more secure and stable manner. Even with the small nest intervals $D_1$ and $D_2$ of the respective container body 10 and base 12 herein, the rims 18 and 20 allow the mechanical devices of the processing equipment to readily separate the parts in a trouble free fashion from the stack.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

What is claimed is:

1. A plastic container comprising, in combination:

an injection molded upper main body portion having a hollow interior and a frustoconical sidewall extending from a small diameter top to a larger diameter bottom;

an annular rim projecting radially outward from the larger diameter bottom of the frustoconical sidewall of the upper main body portion for cooperation with automatic container feeding equipment;

an injection molded lower base portion having a frustoconical wall shorter than the frustoconical sidewall and including a top base wall with the frustoconical wall depending from the top base wall to a larger diameter bottom thereof, said top base wall including a raised section with a thickened central portion having opposing upper and lower, convex surfaces;

an annular arm projecting radially outward at the larger diameter bottom of the frustoconical wall for cooperation with automatic container feeding equipment; and welded plastic areas that are formed between the upper main body portion and the lower base portion for joining the respective annular rims together.

2. A container in accordance with claim 1 wherein the frustoconical sidewall of the upper main body portion includes an interior surface thereof having an annular stacking shoulder that extends around the top of the frustoconical sidewall and allows upper main body portions to be stacked one on top of the other in a compact, vertical arrangement, with the frustoconical sidewall having an upper sidewall section and a lower sidewall section, with the upper sidewall section being thicker than the lower sidewall section, and wherein the annular stacking shoulder is proximate a junction between the upper and lower sidewall sections.

3. A container in accordance with claim 1 wherein at least one of the annular rims includes an energy director area for forming the welded plastic areas with the energy director areas being melted when the annular rims are joined for ultrasonic bonding of the upper main body and lower base portions together.

4. A plastic container having an interior for containing a food product, the container comprising, in combination:

an upper main body portion having a body wall of a substantially frustoconical shape and of predetermined thickness, a top and a bottom, with the body wall tapered from a smaller diameter at the top to a larger diameter at the bottom;

a lower base portion for being attached ultrasonically to the upper main body portion at the bottom of the body wall, said lower base portion including a base wall for supporting food product in the interior of the container, with the base wall including raised section with a thickened central portion having opposing upper and lower, convex surfaces;

an energy director area between the upper and lower container portions being welded together and assisting the upper main body and a lower base portions to be ultrasonically attached together; and an exterior print receiving surface portion of the body wall which is smooth over substantially its entire extent, and extending substantially between the top and the bottom of the body wall to provide a large uninterrupted, smooth area on the body wall to receive printing thereon.

5. A container in accordance with claim 4 wherein a circumferential stacking shoulder extends around the interior of the body wall of the upper main body portion at the top thereof and allows upper main body portions to be stacked one on top of the other in a compact, vertical arrangement, with the body wall including an upper sidewall section and a lower, frustoconical sidewall section, with the upper sidewall section being thicker than the lower, frustoconical sidewall section, and wherein the stacking shoulder is provided proximate a junction between the upper and lower sidewall sections.

6. A container in accordance with claim 4 wherein the lower base portion includes a sidewall depending from the base wall and substantially conforming to the body wall adjacent to the bottom thereof with the sidewall having a plurality of circumferentially spaced stacking ribs which allow lower base portions to be stacked one on top of the other in a compact, vertical arrangement, each of said stacking ribs having an inner radial edge portion which extends substantially parallel to the body wall and sides provided with a slight draft from the base wall towards a bottom rib surface.

7. A container in accordance with claim 6 wherein the upper main body and lower base portions are ultrasonically attached and have inclined surfaces relative to the base wall for distributing loads of the food product about the center of the base wall to provide added container strength.

8. A container in accordance with claim 4 in which the body wall defines an access opening at its top which is scaled by a thin foil member extending over the access opening and down the body wall, and a top circumferential horizontal shoulder on the body wall above the exterior print receiving surface portion to allow for easy removal of the foil member from the top of the upper main body portion over the access opening to access food in the interior of the container.

9. A container in accordance with claim 8 wherein the upper main body portion includes a lower annular flange below the exterior print receiving surface portion and the lower base portion includes a lower annular flange with the energy directors on one of either the lower annular flanges of the upper main body portion and the lower base portion.

10. A container in accordance with claim 9 wherein the energy directors are formed on top of the lower annular flange of the lower base portion and the lower annular flange of the upper main body portion includes a lower surface having a rough and irregular texture for ultrasonically welding the top of the lower annular flange of the lower base portion to the lower surface of the lower annular flange of the upper main body portion.

11. A plastic container comprising, in combination:

an upper container portion having a hollow interior and a frustoconical sidewall;

a lower container portion having a bottom wall, including a raised section with a thickened central portion having opposing upper and lower, convex surfaces, and a frustoconical sidewall depending therefrom, with the upper container portion and the lower container portion being ultrasonically attached together to form a product receiving space in the container with the bottom wall supporting food product in the product receiving space; and stacking shoulders adjacent tops of the upper and lower container portions to minimize the distance between the tops of the upper and lower container portions and the respective stacking shoulders for providing stacking of upper container portions on each other and lower container portions on each other in a compact vertical arrangement.

12. A container in accordance with claim 11 wherein the upper and lower container portions each include a bottom annular rim having a predetermined wall thickness; and energy directors are formed on one of the bottom annular rims of the upper and lower container portions and provide an increase in thickness beyond the predetermined wall thickness.

13. A container in accordance with claim 12 wherein the bottom annular rims of the upper and lower container portions each have an upper surface and a lower surface with the upper surface of the bottom annular rim of the lower container portion having an energy director area and the lower surface of the bottom annular rim of the upper container portion having a rough and irregular texture for ultrasonically attaching the upper and lower container portions together.

14. A container in accordance with claim 11 wherein the upper container portion contains a print receiving surface extending along its frustoconical sidewall from the stacking shoulder down to a lower end of the frustoconical sidewall.

15. A container in accordance with claim 11 wherein the stacking shoulders of the lower container portion comprises a plurality of stacking ribs on the frustoconical sidewall circumferentially spaced therearound and disposed below the bottom wall thereof which allow lower container portions to be stacked on top of the other in a compact, vertical arrangement, each of said stacking ribs having an inner radial edge portion which extends substantially parallel to the frustoconical sidewall and sides provided with a slight draft from the bottom wall towards a bottom rib surface.

16. A container in accordance with claim 11 wherein the upper and lower container portions include inclined surfaces relative the bottom wall for distributing loads of the food product to increase resistance to cracking of the bottom wall when the container loaded with food product is subject to drop tests.

17. An upper container portion for an injection molded plastic container having a hollow interior for receiving food products therein, the upper container portion comprising:

a sidewall having a small diameter top and a larger diameter bottom, the sidewall having a thru opening at the top which leads to the bottom, with the sidewall including an upper sidewall section and a lower, frustoconical sidewall section, with the upper sidewall section being thicker than the lower, frustoconical sidewall section;

an annular stacking ring projecting radially inward along the interior of the sidewall, proximate a junction between the upper and lower sidewall sections, that allows upper container portions to be stacked one on top of the other in a compact vertical arrangement; and an annular flange projecting radially outward from the bottom of the lower frustoconical sidewall section and having welding areas therearound disposed for ultrasonic attachment with another container portion, with the annular flange capable of cooperating with high speed automatic container feeding equipment.

18. A lower container portion for a plastic container having a hollow interior for receiving food product therein, the lower container portion comprising:

a base wall for supporting food products in the container interior;

a frustoconical sidewall depending from the base wall at a small diameter top down to a larger diameter bottom thereof;

a plurality of circumferentially spaced stacking ribs located on the frustoconical wall below the base wall which allow lower container portions to be stacked one on top of the other in a compact vertical arrangement, each of said stacking ribs having an inner radial edge portion which extends substantially parallel to the frustoconical sidewall and sides provided with a slight draft from the base wall towards a bottom rib surface; and an annular flange projecting radially outward from the bottom of the frustoconical wall and having welding areas disposed therearound for ultrasonic attachment with other lower container portions, with the annular flange capable of cooperating with high speed automatic container feeding equipment.

19. An upper container in accordance with claim 17, wherein the upper sidewall section has a substantially constant diameter from the small diameter top to the annular stacking ring.

20. An upper container in accordance with claim 17, further comprising:

an exterior, circumferential shoulder defined between the upper and lower sidewall sections; and a series of circumferentially spaced outer ribs extending between the shoulder and the upper sidewall section.

* * * * *